United States Patent [19]

Fixler

[11] 3,948,522

[45] Apr. 6, 1976

[54] PROJECTILE SIMULATION

[75] Inventor: Jon S. Fixler, Philadelphia, Pa.

[73] Assignee: Industrial Patent Development Corporation, Philadelphia, Pa.

[22] Filed: Apr. 4, 1973

[21] Appl. No.: 347,933

[52] U.S. Cl...... 273/101.2; 273/85 R; 273/102.2 R; 273/186 A

[51] Int. Cl.[2] ..... A63F 9/02

[58] Field of Search..... 273/101, 101.1, 101.2, 273/102.2 S, 102.2 B, 186 A; 35/25; 181/.5 AG, .5 ED, .5 J; 340/1 R, 16 R, 147 C; 46/1 E, 232, 244 C, 244 B; 178/DIG. 15; 124/1

[56] References Cited

UNITED STATES PATENTS

| | | | |
|---|---|---|---|
| 1,969,037 | 8/1934 | Rieber | 181/.5 J |
| 2,817,025 | 12/1957 | Adler | 178/DIG. 15 |
| 2,832,426 | 4/1958 | Seargeant | 46/244 B X |
| 2,838,850 | 6/1958 | Stephenson et al. | 273/102.2 S UX |
| 3,029,305 | 4/1962 | Marks et al. | 178/DIG. 15 |
| 3,104,478 | 9/1963 | Strauss et al. | 273/101.1 UX |
| 3,294,401 | 12/1966 | Nicholas et al. | 273/101.1 |
| 3,321,737 | 5/1967 | Russell | 340/1 R |
| 3,336,572 | 8/1967 | Paull et al. | 340/16 C |
| 3,400,393 | 9/1968 | Ash | 343/6.5 R |
| 3,417,237 | 12/1968 | Fenton | 273/101.1 X |
| 3,426,475 | 2/1969 | Foster | 273/101.1 X |
| 3,633,285 | 1/1972 | Sensney | 273/101.1 X |
| 3,718,896 | 2/1974 | Mowat | 340/1 R |
| 3,739,299 | 6/1973 | Adler | 340/147 C X |
| 3,783,967 | 1/1974 | Apgar | 181/.5 ED |
| 3,794,964 | 2/1974 | Katakura | 340/1 R |

FOREIGN PATENTS OR APPLICATIONS

| | | | |
|---|---|---|---|
| 1,388,417 | 12/1964 | France | 273/101.1 |

*Primary Examiner*—Richard C. Pinkham
*Assistant Examiner*—Harry G. Strappello
*Attorney, Agent, or Firm*—Nelson E. Kimmelman

[57] ABSTRACT

The aimed launching of projectiles is simulated by means of an electroacoustic transducer which is energized to emit a beam of sound waves, preferably at ultrasonic frequency. A cooperating target also employs an electroacoustic transducer and apparatus for indicating reception of the sound beam by that transducer. The emitter transducer may be mounted in a simulated firearm, or other projectile launcher, while the receiver transducer may be mounted on a simulated target.

13 Claims, 10 Drawing Figures

PROJECTILE SIMULATION

BACKGROUND OF THE INVENTION

1. Field of the Invention

The invention relates to techniques for simulating the launching of projectiles and for determining the direction of launch.

More particularly, the invention relates to new and improved techniques of simulating the aimed firing of guns, the aimed propulsion of balls by cues or clubs, and the like.

2. Description of the Prior Art

There are many occasions when it is desirable to simulate the aimed launching of projectiles.

For example, it is often desirable to engage in rifle or pistol target practice in close quarters, where the use of real weapons with live ammunition is too noisy, or too dangerous. Also, real weapons and ammunition are costly, and their use normally requires official permission which may be difficult, if not impossible to obtain.

Therefore, a harmless, inexpensive gunfire simulation technique useable for target practice would be highly desirable.

Another example involves toy guns, with which live ammunition can obviously not be used. It is believed that a substantial demand exists for toys which permit simulation of gunfire that is realistic in terms of aiming accuracy and indication of hits and misses.

Attempts have previously been made to provide such simulations, using light to simulate the projectiles. To this end a source of a light beam is mounted in a gun-like structure, and turned on in response to pulling of the trigger in order to simulate the firing of a bullet.

A photocell is mounted on a target at the spot of intended impact of the simulated bullet. If the bullet-simulating light beam strikes the photocell, and does so with sufficient intensity, and electronic circuit lights a lamp, or rings a bell, or otherwise provides an indication of a hit. Absence of such indication signals a miss.

The usefulness of such a simulation depends on several factors.

First, the light beam used to simulate the bullet must be intense enough that, even at the considerable distance at which the target with its photocell may be located, that photocell is capable of distinguishing the beam from the ambient illumination to which the photocell is also exposed. This in itself is a very taxing requirement. Since the gun with its light source must be portable, it is normally battery-powered. This severely limits the intensity of the light beam which it can project. That is especially true for toy guns, which must be capable of being handled by children. Powerful batteries would be too heavy, not to mention too expensive for such toy applications.

Another factor which affects the usefulness of simulation by light beam is the requirement that the beam be so well focused that it reaches the distant target with a small and well-defined cross-section. This is important for two reasons. A broad beam distributes the already inadequate amount of light reaching the target over a large area, and thereby further reduces the fraction of that light which falls on the active area of the target photocell. In addition, if the light beam is spread over an area of the target substantially greater than the active photocell area, then the photocell is no longer able to distinguish between the case when the simulated gun is aimed directly at it, and the case when the gun is aimed incorrectly, but light still reaches the photocell because of the large cross-section of the beam. The photocell then causes a hit to be registered in either case, and this greatly diminishes the effectiveness of the simulation.

This factor creates a particularly difficult problem in attempting to achieve simulation by light beam. The reason is that the optics needed to keep a light beam from diverging too far over normal gun-to-target distances are prohibitively complex and costly for most situations.

Still other, more subtle shortcomings of attempts to use light beams for simulating aimed projectile launching will be pointed out later, in discussing the various aspects of the present invention.

BRIEF SUMMARY OF THE INVENTION

Accordingly, it is an object of the invention to overcome one or more of the above-mentioned limitations of the prior art.

It is another object to provide techniques for simulating the behavior of projectiles which are not subject to the limitations inherent in using light for such simulation.

It is another object to provide techniques which simulate with great realism the behavior of projectiles.

It is another object to provide techniques for realistically simulating the operation of firearms.

It is still another object to provide techniques for determining the direction of launch of projectiles.

These, and other objects which will appear, are achieved as follows.

A beam of sound waves is emitted in a predetermined direction. Provisions are made for receiving such a beam of sound waves at a remote location, and for producing an indication of its reception.

The emission of this beam of sound waves simulates the launching of a projectile. Its reception simulates the striking of a target by the projectile.

The apparatus which emits the beam of sound preferably includes an electroacoustic transducer, an electrical circuit for intermittently energizing that transducer to produce the desired sound waves, and a source of electrical power, such as a battery. Provisions are also made for causing these sound waves to be emitted in a concentrated beam, rather than broadcast in all directions.

The receiving apparatus includes an electroacoustic transducer for retransforming the received beam of sound waves into electrical signals. It also includes amplifying and detecting circuits for these electrical signals, and an indicator energized by them. Again, a battery preferably constitutes the source of receiver power.

In the application of the invention to the simulation of rifle or pistol fire, the emitter apparatus is preferably mounted in an appropriately simulated firearm, and so configured that the beam of sound waves is emitted with a directionality which simulates the normal projectile dispersion pattern of the real firearm. The receiver apparatus, on the other hand, is mounted on the target for the firearm, with the electroacoustic transducer positioned at the intended spot of impact of the firearm projectiles.

BRIEF DESCRIPTION OF THE DRAWINGS

For further details, reference may be had to the description which follows, in the light of the accompanying drawings wherein.

DETAILED DESCRIPTION

Figure 1:
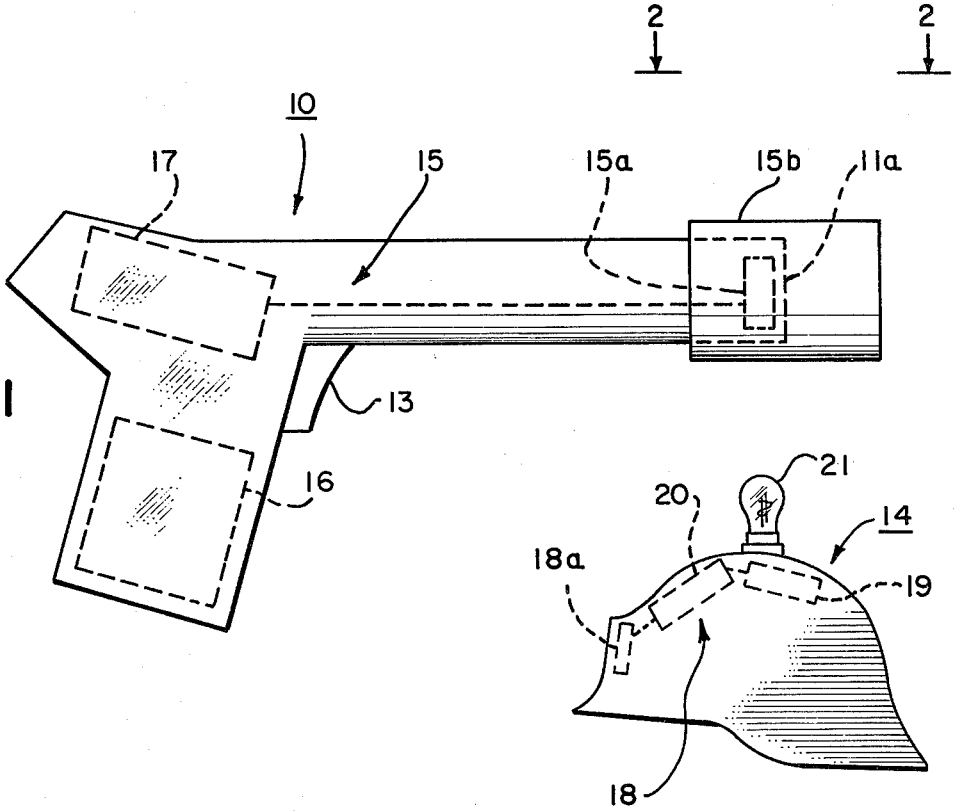
FIG. 1 is a diagrammatic illustration of the overall arrangement of an embodiment of the invention, as applied to toy pistol simulation.

FIG. 1, to which reference may now be had, shows the general arrangement of an embodiment of the invention, as applied to toy pistols. Such a toy pistol is diagrammatically illustrated at 10, and includes a barrel 11, a grip 12, and a trigger 13.

A target 14 is provided for cooperation with toy pistol 10. Target 14 may take any desired form, such as that of a helmet to be worn by a participant in the game involving toy pistol 10.

Within toy pistol 10 is located apparatus, shown in broken lines in FIG. 1 and generally designated by reference number 15, for emitting a beam of sound waves in a direction aligned with barrel 11. Emitter apparatus 15 includes an electroacoustic transducer 15*a*, which is positioned inside barrel 11, near its muzzle 11*a*. It also includes a battery 16 which may be placed inside pistol grip 12, and electronic circuitry 17, which may be packaged between battery 16 and transducer 15*a*. The battery, circuitry and transducer are, of course, electrically connected together.

As described more fully hereinafter, pulling of trigger 13 energizes transducer 15*a* so that it produces a burst of sound waves. The transducer is so constructed that these sounds waves form a beam which propagates in a direction substantially in line with that in which barrel 11 points. This beam forming property of transducer 15, itself, is further accentuated by its position within barrel 11, and may be still further aided by a diaphragm structure 15*b*, discussed in detail later. Thus, from muzzle 11*a* there issues a beam of sound waves propagating in the direction of aim of toy pistol 10.

On helmet 14 is mounted apparatus, shown in broken lines in FIG. 1 and generally designated by reference numeral 18, for receiving sound waves such as those from emitter apparatus 15.

Receiver apparatus 18 includes electroacoustic transducer 18*a*, which may be mounted facing forwardly in a recess on the front of helmet 14. The receiver apparatus further includes a battery 19, and electronic circuitry 20, which may be mounted within the helmet as diagrammatically illustrated in FIG. 1, and an indicator, such as lamp 21, which may be mounted on the top of the helmet. As described more fully hereinafter, impingement on receiver transducer 18*a* of the beam of sound waves from toy pistol 10 causes lamp 21 to light, thereby registering a simulated hit.

As previously mentioned, the sound waves from emitter apparatus 15 propagate in a directional beam. Receiver transducer 18*a* is preferably of a configuration such that its sound-sensitive area conforms generally to the cross-sectional area of that beam. By so configuring the receiver transducer and also appropriately adjusting the sensitivity of the receiver apparatus, it is possible to cause lamp 21 to light only if toy pistol 10 is aimed substantially directly at receiver transducer 18*a* at the time trigger 13 is pulled. In this way, toy gun 10 and helmet 14 cooperate to realistically simulate aimed gunfire.

It is recognized that there exists some superficial resemblance between the beam of sound waves from toy pistol 10 and the light beam which the prior art had endeavored to use in simulating gunfire. However, this resemblance is deceptive. As previously noted, it has proven impractical to produce a light beam which is bright enough to stand out from the ambient illumination, and focused enough to simulate the small impact area of a bullet, within the physical and economic constraints which apply.

In contrast, I have found that beams of sound waves utilized in accordance with the present invention are not subject to these disabilities.

In particular, I have found that neither the physical nor the economic constraints applicable to toy pistols need to be violated when using such beams of sound waves.

Thus, the physical configuration of toy pistol 10 may be entirely conventional. It may be of plastic or any other conventional material. Its barrel 11 may typically be approximately 8 inches long, with an internal diameter sufficient to mount emitter transducer 15*a* therein. All other pistol dimensions may be commensurate, and may, of course, be varied to suit.

Emitter transducer 15*a* may also be of conventional from, such as is available, for example, from the Massa Division of Dynamics Corporation of America, Ingham, Massachusetts.

Such a transducer, particularly when positioned within barrel 11 some distance back from muzzle 11*a*, provides a sound beam whose cross-section is comparable to the internal diameter of barrel 11 when the sound beam issues from muzzle 11*a*. After leaving the muzzle, the sound beam is, of course, subject to some dispersion, but of much lesser degree than a light beam formed with comparable equipment simplicity. In fact, experiments have shown that the simple use of transducer 15*a* in barrel 11 produces a sound beam of so little dispersion as to be useful for simulating aimed toy pistol firing at distances up to 25 feet or even more.

Even further limitation of sound beam dispersion can be obtained by means of diaphragm structure 15*b*. Details of this diaphragm structure are diagrammatically illustrated in FIGS. 2A through 2D, to which reference may now be had.

Each of these figures shows a portion of barrel 11 near muzzle 11*a*.

Figure 2A:
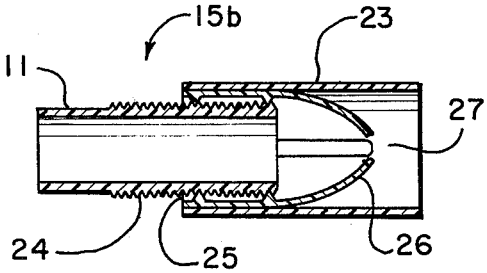
FIGS. 2A through 2D show certain details of the sound beam emitter apparatus forming part of the embodiment of FIG. 1.
Figure 2B:
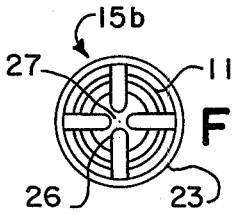
Figure 2C:
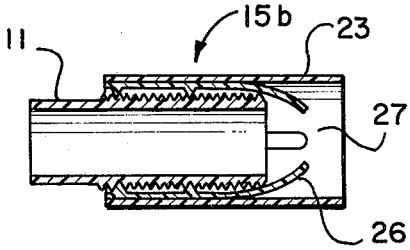
Figure 2D:
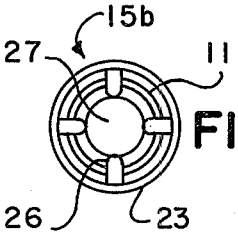

FIGS. 2A and 2C show elevational cross-sections taken along line 2—2 of FIG. 1, and FIGS. 2B and 2D show the corresponding end views. As shown in these figures, a sleeve 23, which may have the outward appearance of a pistol silencer, encircles the muzzle end of barrel 11. The amount by which sleeve 23 overlaps barrel 11 is adjustable by means of an external thread 24 on the barrel, and mating, thread-engaging rings 25 within sleeve 23.

Attached to the inner periphery of sleeve 23 are uniformly spaced, finger-like elements 26, which extend lengthwise with respect to barrel 11. Elements 26 are preferably made of thin strips of flexible plastic material. As shown in FIGS. 2A and 2B, strips 26 are shaped so as to normally curve inwardly toward each other, thereby defining a small central aperture 27 whenever sleeve 23 is adjusted so as to overlap barrel 11 by a small amount. As sleeve 23 is rotated to increase the amount by which it overlaps barrel 11, muzzle 11*a* will progressively force finger-like elements 26 farther and farther apart, thereby enlarging more and more the central aperture 27 defined by these elements. The condition in which aperture 27 is largest is shown in FIGS. 2C and 2D. I have found that such adjustment of the size of aperture 27 controls the divergence of the beam of sound waves produced by toy piston 10, and therefore the cross-section of that beam, at the target.

Specifically, when sleeve 23 is adjusted to make aperture 27 largest (FIGS. 2C and 2D) then the sound beam will have substantially the degree of divergence—and the resulting cross-section at the target—determined by transducer 15*a* and its position in barrel 11. As aperture is made smaller and smaller through appropriate adjustment of sleeve 23, the divergence—and the resulting sound beam cross-section at the target—will correspondingly decrease, being least when aperture 27 is smallest (FIGS. 2A and 2B).

The degree of beam divergence, in turn, determines the target distance up to which the pistol fire simulation provided by the arrangement of FIG. 1 will be realistic. The less the beam diverges, the greater the distance from pistol 10 at which the impact of a bullet is realistically simulated.

Consequently, the amount by which sleeve 23 overlaps barrel 11 can be calibrated in terms of target distance. This further enhances the entertainment value of toy pistol 10, which can thus be provided with what amounts to an adjustable gunsight. Shot, so as to simultate different types of power and dispersion.

Figure 3:
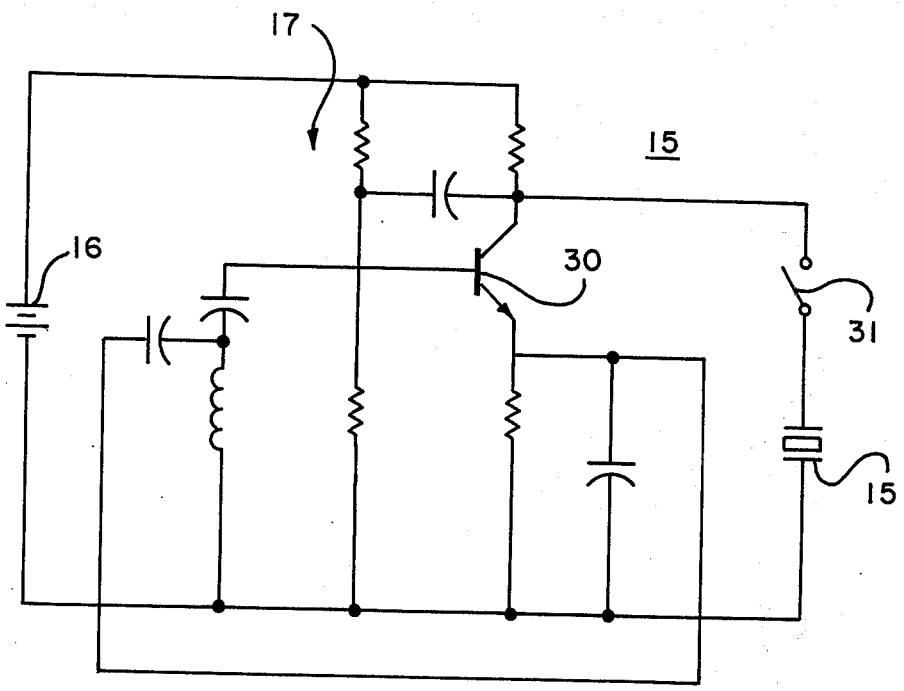
FIG. 3 is a schematic diagram of the electronic components forming part of the emitter apparatus of FIG. 1.

FIG. 3, to which reference may now be had, shows a schematic diagram of a preferred form of the electronic components of emitter apparatus 15 in FIG. 1. As shown in FIGG 3, circuitry 17 is an oscillator circuit built around a transistor 30. This oscillator circuit is adapted to be energized by battery 16, and in turn excites tranducer 15*a*, which also contributes to determining the frequency of oscillation. A switch 31 is mechanically linked to, and operated by trigger 13 of toy pistol 10. When switch 31 is closed, the oscillator circuit is energized and oscillates; when the swtich is open, the oscillator is deenergized and its oscillation stops.

For reasons discussed more fully hereafter, the circuit constants of circuitry 17 are preferably chosen, in conventional fashion, so that transducer 15*a* is excited at an ultrasonic frequency. A frequency in the neighborhood of 23 KHz has been found particularly suitable.

Figure 4:
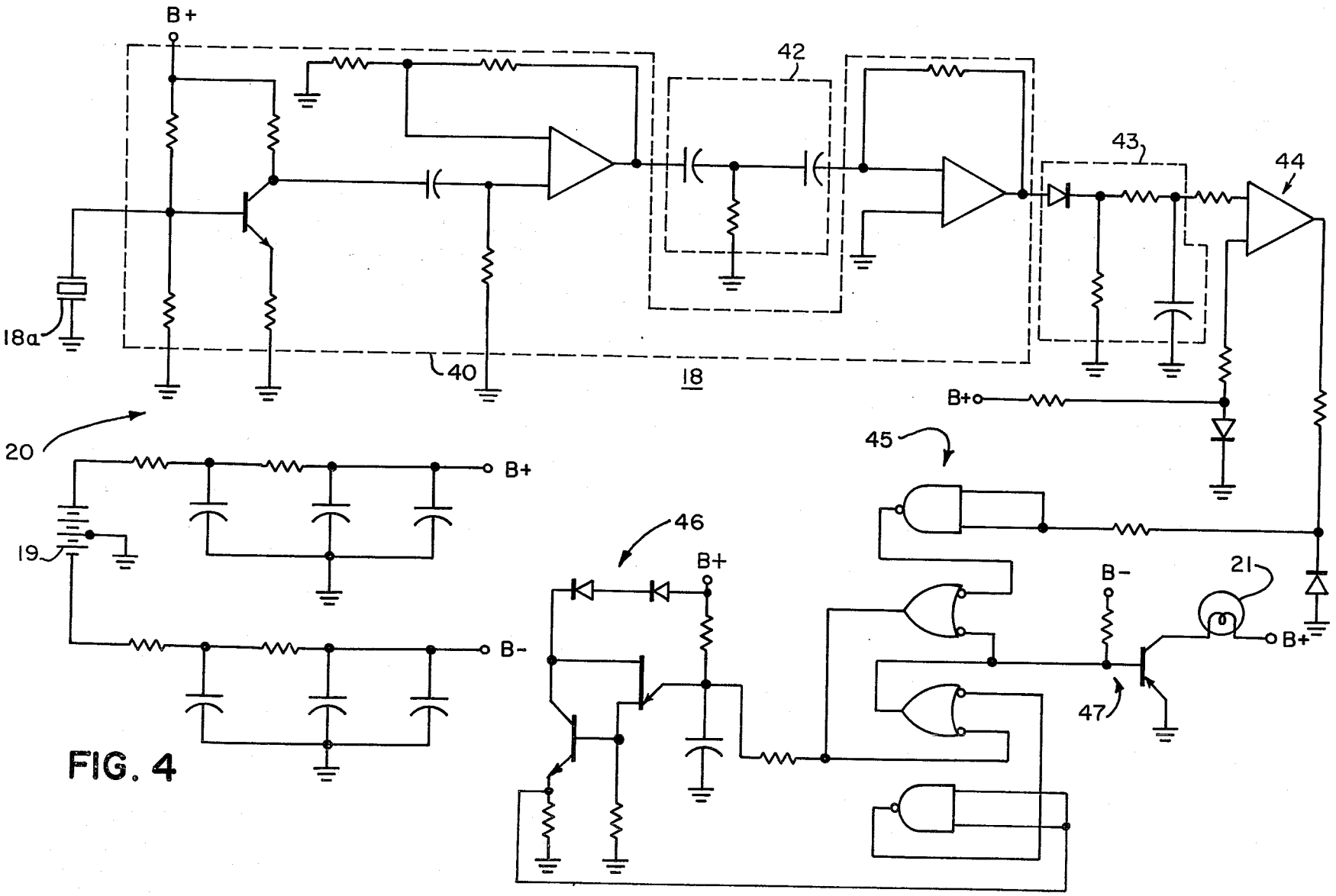
FIG. 4 is a schematic diagram of the electronic components forming part of the sound beam receiver included in FIG. 1.

FIG. 4, to which reference may now be had, shows a schematic diagram of a preferred form of the electronic components of receiver apparatus 18 of FIG. 1.

Circuitry 20 includes a multistage amplifier 40, supplied with electrical signals from transducer 18*a*. The signals traversing amplifier 40 are restricted in frequency by a high-pass filter 42, which may be connected between two stages of amplifier 40 and proportioned to transmit signals of the ultrasonic frequency (e.g. 23 KHz) of the sound waves from toy pistol 10, while attenuating substantially lower frequencies, and particularly frequencies in the audible acoustic range.

The signals from filter 42 are supplied to a detector 43, where their envelope is detected in conventional manner. Thus an electrical pulse is produced at the output of detector 34 each time sound waves emitted from toy pistol 10 in response to the pulling of its trigger 13 reach receiver transducer 18*a*.

These electrical pulses are supplied to comparator circuit 44, which is also supplied with a predetermined reference voltage derived from receiver battery 19. Comparator 44 responds to produce an output signal only when the pulse from detector 43 exceeds the value of the reference voltage from battery 19.

The output signal from comparator 44 is supplied to flip-flop circuit 45, where it triggers a state-change of the flip-flop. A replica of that change is derived, delayed by means of delay circuit 46 and fed back to flip-flop 45, which it restores to its original state.

A signal representing the changed state of flip-flop 45 is supplied to output amplifier 47, which responds thereto to cause battery current to flow through lamp 21 for an equivalent period.

Thus, lighting of lamp 21 corresponds to impingement of sound waves from toy pistol 10 upon receiver transducer 18*a*.

The elements of FIG. 4 are all conventional electronic circuit building blocks. The stages of amplifier 40 may be conventional solid state operational amplifiers, and the flip-flop 45 may also be composed of conventional solid state logic elements.

Some of the important features of the embodiment of the invention described in connection with FIGS. 1 through 4 will now be highlighted.

First, a very simple structure, consisting of the barrel 11 of pistol 10, the emitter transducer 15*a* and the diaphragm structure 15*b*, suffices to form the sound waves produced by the transducer into a beam which exhibits limited divergence as it leaves muzzle 11*a* and travels in the direction in which pistol 10 is aimed. Through appropriate adjustment of aperture 27, as previously explained, this beam can be kept, at normal target distances, from becoming broader than desired for simulating a real bullet.

Reception of this sound beam at the receiver transducer 18*a* therefore provides an indication of correct pistol aim.

Compared to the optics which would have to be used to equivalently limit the divergence of a light beam, applicant's embodiment is extremely simple, and correspondingly light in weight and low in cost.

Secondly, emitter transducer 15*a* is capable of producing, and receiver transducer 18*a* is capable of responding to a narrow spectrum of sound wave frequencies, particularly when used in conjunction with electronic circuitry such as shown in FIGS. 3 and 4. This frequency selectivity in effect increases the over-all sensitivity of the arrangement, because all the available transmitter power can be concentrated in these selected frequencies and because ambient sounds at other frequencies are in effect ignored by the receiver.

This leads to power requirements, at both the pistol and the target, which can readily be met by batteries that are small, lightweight and inexpensive.

This, too, is strikingly different from what happens when light beams are used. Lamps are inherently sources of a wide spectrum of light frequencies, and color filters for restricting the frequency range of the light beam are not helpful, because they simply waste the light energy which they eliminate from the beam.

Another feature involves the reference voltage applied to comparator 44 of FIG. 4. The level of this voltage determines how strong the detected signal from detector 43 must be, and therefore also how strong the sound waves impinging on receiver transducer 18*a* must be, in order for lamp 21 to light. By adjustment of this reference voltage level, in conventional manner, the sensitivity of the overall arrangement can therefore be conveniently controlled.

Although sound waves in any desired frequency range (including the audible range) may be used in accordance with the present invention, ultrasonic waves are preferred. They cannot be heard and therefore are not objectionable to non-participants, they do not reveal the position of the pistol which is being simulated, and they are outside the range of much ambient sound, thereby contributing to the ability of the invention to function without excessive power demands.

It will be understood that various modifications of the embodiment of FIGS. 1 to 4 are possible without departing from the inventive concept.

For example, receiver transducer 18*a* and its cooperating electronic circuitry 20, battery 19 and lamp 21 need not be mounted on a helmet. Instead, these elements can be mounted on any desired target, such as a piece of clothing, or a conventional bullseye type of target.

Also, instead of having a directional receiver arrangement at the helmet, an omnidirectional receiver may be used. To this end, the receiver transducer 18*a* may be positioned on top of helmet 14, directly below lamp 21, and a foam plastic block may be positioned directly above the transducer, between it and the lamp, so as to conduct sound waves from all directions to the transducer.

In fact, a target structure separate from pistol 10 is not always necessary. If desired, receiver transducer 18*a*, circuitry 20, and lamp 21 can be incorporated right into toy pistol 10. In that case, tranducer 18*a* may be mounted on the pistol in a position to receive sound waves which were originally emitted from transducer 15*a* and which have been reflected directly back toward toy pistol 10 from some external sound reflecting object. Battery 19 may then be omitted and battery 16 used to power the entire unit. In this alternative arrangement, trigger 13 not only activates transducer 15 but is also coupled to receiver circuitry 20 so as to disable that circuitry while transducer 15 is active. This prevents false indications not due to sound wave reflections.

In this alternative, a small parabolic reflector may also be used to provide the desired reflection back to the pistol. This reflector can be positioned at some suitable reflection point, e.g. a wall to which it may be attached by a suction cup.

Another modification involves providing a conventional means for causing the oscillations in circuit 17 of FIG. 3, to stop a predetermined, brief interval after trigger 13 has been pulled, so that repeated trigger pulls are necessary to simulate repeated firing of the toy pistol.

Such means may be a mechanical toggle arrangement, which causes switch 31 to reopen shortly after pulling of trigger 13 has caused it to close. Alternatively, electrical means may be used for equivalent purpose. For example, closing of switch 31 may energize a relay circuit, whose closing in turn energizes the oscillations. A capacitor may also start charging simultaneouslly. This capacitor may be connected so as to reopen the relay after a period determined by the capacitor charging time constant, thereby stopping the oscillations.

In either of these cases, the detector 43 forming part of receiver 18 may then be constructed, in conventional manner, to have a time constant comparable to the period during which any one pull on trigger 13 causes the emission of a sound beam from pistol 10.

In this way, receiver 18 be protected from responding to sound waves of shorter duration and will therefore discriminate even more effectively against unwanted noise which may impinge on receiver transducer 18*a*.

The hit indicator 21 need not be a lamp, but may be a buzzer, or even an electronic scoring device of any conventional form, triggered by circuitry 20 of FIG. 4.

Also, electronic or electro-mechanical delay means may be incorporated in the means which lights lamp 21, so that there is a controllable time delay between the reception of the sound beam and the indication of this reception.

Also, means can be provided in the receiver for deactivating same for a predetermined period after an indication of a hit.

Aperture 27 in diaphragm structure 15*b* need not be formed by the plastic finger-like elements 26, but may be formed in other ways, as, for example, by the kind of diaphragm used to control the lens opening of a camera.

As previously indicated, the sound waves are not necessarily at ultrasonic frequencies, but may be intentionally within the audible range. This alternative may be used for example, to simulate the detonation of the toy pistol at the same time that the sound beam is emitted. In that case, the parameters of the electronic components would, of course, have to be correspondingly chosen, in conventional manner. Alternatively, the detonation sound may be provided by conventional means, as by a conventional explosive cap arrangement built right into pistol 10. Also mechanical means may be built into the pistol to simulate the recoil of a real weapon. This can also be done by loading the pistol conventionally with blank cartridges, detonated by pulling of trigger 13.

In any case it will be noted that the use of sound waves approximates much more closely the speed of a projectile than would the use of light, which travels at a much, much higher speed.

Another modification involves relying on mechanical resonance at the receiver to provide detection of the sound waves from the emitter apparatus 15. To this end, the receiver transducer 18*a* may be in the form of a reed, proportioned to resonate in response to the frequencies produced by the emitter apparatus. If these frequencies are in the ultrasonic range, then the reed is preferably proportioned to resonate at an audible subharmonic of the printed frequency. For example, for a frequency of 23 KHz produced by the emitter apparatus, the receiver reed may resonate at the fourth subharmonic, i.e. at 5.75 KHz. Consequently, an audible tone is directly produced by the reed, upon impingement of the beam from the toy pistol. Such use of the resonance effect would not normally be feasible if a beam of light were used to simulate the projectile.

Figure 5:
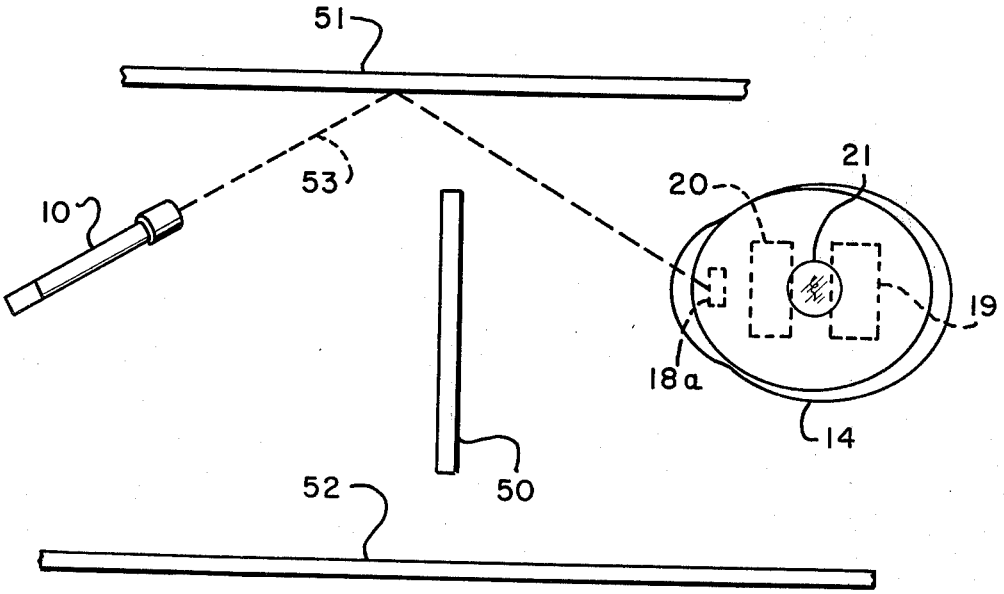
FIG. 5 is a diagrammatic illustration of a modification of the embodiment of FIG. 1.

Still another modification is illustrated, in its general arrangement, in FIG. 5, to which reference may not be had. This figure shows, in top view, a form of target game which may utilize the same toy pistol 10 as FIG. 1, and also the same receiver transducer 18*a* with its battery 19, receiver circuitry 20 and indicator lamp 21.

In this arrangement, however, transducer 18*a* is intentionally screened from direct impingement by the beam of sound waves from toy pistol 10. To that end, a barrier 50 may be positioned between transducer 18*a* and pistol 10. Although preventing direct sound wave impingement on transducer 18*a*, barrier 50 does not prevent such impingement by sound waves which circumvent barrier 50. Such circumvention may be the result of reflection from sidewalls 51 and 52, which may be the walls of a room in which toy pistol 10 is being used. For example, the toy pistol may be pointed at an acute angle to wall 51, as shown in FIG. 5. The beam of sound waves emitted when its trigger is pulled will then follow the broken-line path 53 and reach transducer 18*a* even through that transducer is positioned behind barrier 50.

Thus, in the embodiment of FIG. 5 simulated ricochets are relied on to "hit" the target.

I have found that the sound wave reflections which simulate such ricochets retain to an appreciable degree the beam-like characteristics of the waves emitted from pistol 10. Moreover, comparatively hard surfaces reflect this beam of sound waves more strongly than soft surfaces. Consequently, the former will produce a more pronounced ricochet effect. This enhances the realism of the simulation, since real bullets also have a greater tendency to ricochet from hard than from soft surfaces.

Figure 6:
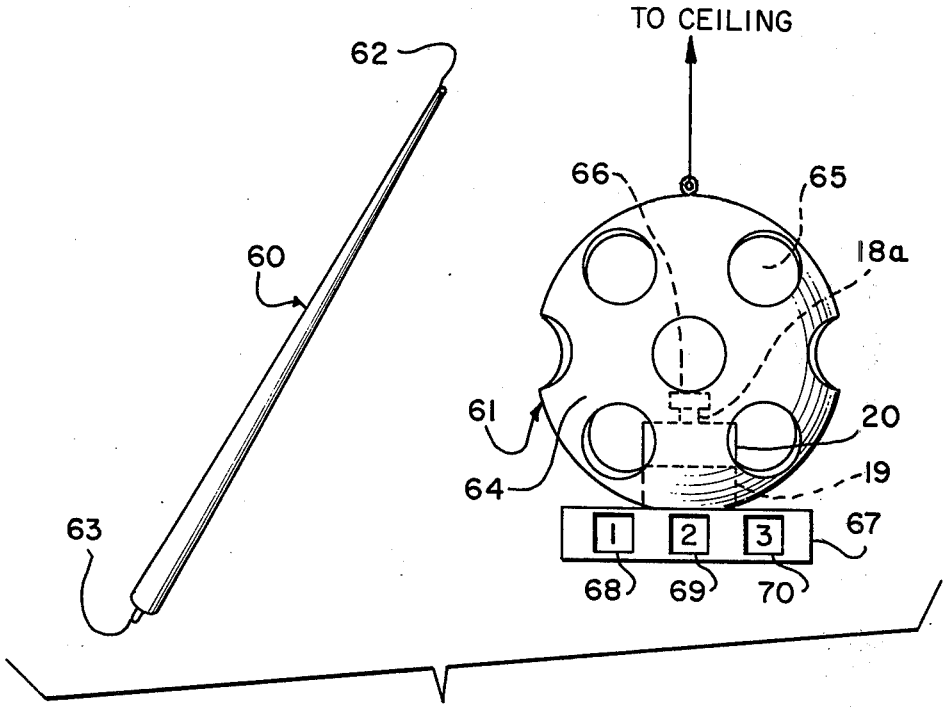
FIG. 6 is a diagrammatic illustration of the application of the invention to a simulated billiard game.

Another application of the invention is shown in FIG. 6, to which reference may now be had, and, which shows the general arrangement of a simulated billiard game.

This billiard game includes a cue 60 and a sphere 61, which may be suspended in any conventional manner a short distance below the ceiling of the room (not shown) in which the simulated billiard game is to be played. Cue 60 may be shaped like a conventional billiard cue. It differs from a conventional cue in that it has an opening 62 at its striking end. Recessed within opening 62 is sound wave emitting apparatus (not shown) which may be similar to apparatus 15 of FIG. 1. At the handle end, cue 60 has a pushbutton 63, which performs the same function as trigger 13 in FIG. 1. When pushbutton 63 is depressed, a burst of sound waves, formed into a beam axially aligned with cue 60, is emitted from opening 62.

As further shown in FIG. 6, the surface of sphere 61 is formed by a sheet 64, which may be made of plastic, and which is pierced by a multiplicity of holes 65. Enclosed within sphere 61 is sound wave receiver apparatus which may be generally similar to receiver apparatus 18 of FIG. 1. This apparatus is indicated in broken lines in FIG. 6. As shown in FIG. 6, transducer 18*a* preferably faces upwardly within sphere 61 and has a block 66 of urethane foam resting directly upon it.

Attached to the outside of sphere 61, preferably directly below it, is a housing 67, containing indicator windows 68, 69 and 70, behind which are lamps (not shown) which can be selectively illuminated to display the lighted numerals 1, 2, and 3, respectively, in the different indicator windows. This arrangement constitutes the equivalent of indicator 21 in FIG. 1. However, instead of using a single lamp as the indicator, the arrangement of FIG. 6 has three lamps, one for each indicator number. A stepping relay (not shown) may be used to connect these lamps sequentially to circuitry 20. Consequently, when sound waves from cue 60 activate receiver transducer 18*a* and circuitry 20, one or another of the numerals 1, 2, or 3 will be lighted, depending on which lamp happens to be connected at that time.

To play this simulated billiard game, one player after another aims cue 60, not directly at sphere 61, but rather at a room surface in such a way that the beam of sound waves produced when pushbutton 63 is depressed will reach the sphere only after reflection from one or more room surfaces. If the cue is well aimed, one of the indicator numerals lights up. The next player must then attempt to "hit" the sphere after a number room surface reflections equal to that indicated by the lighted indicator numeral.

It will be understood that holes 65 enable the sound waves to reach the interior of sphere 61. Foam block 66 transmits this energy to transducer 18*a* irrespective of the specific direction from which it arrives.

Figure 7:
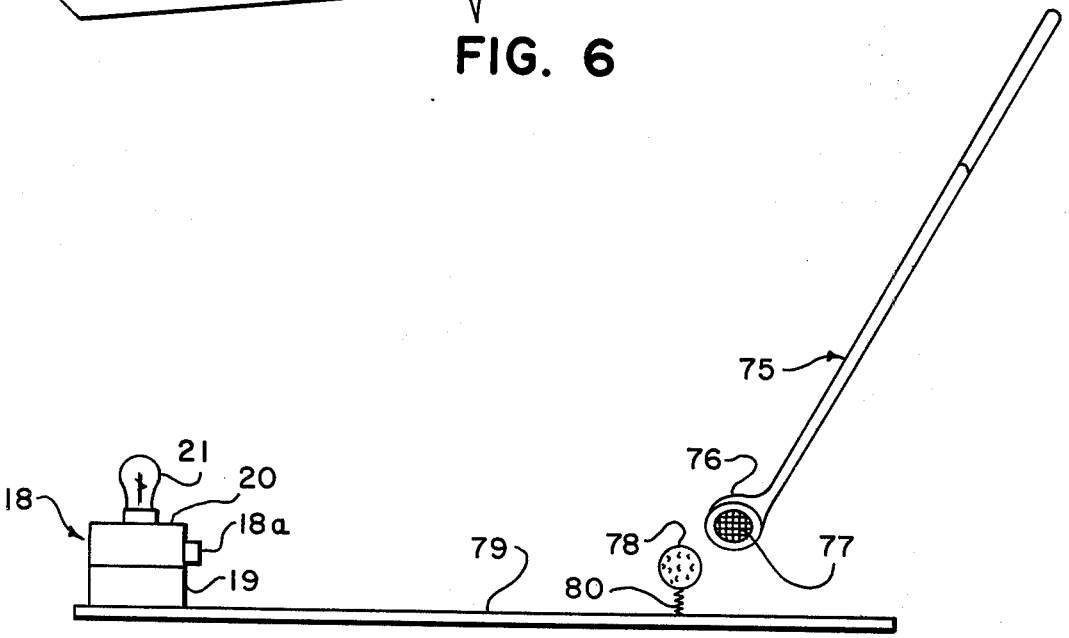
FIG. 7 is a diagrammatic illustration of the application of the invention to a simulated golf game.

Another application of the invention is to a golf game, the general arrangement of which is diagrammed in FIG. 7, to which a reference may now be had. This golf game includes a club 75 which, in its general shape and construction, may be similar to a real golf club. It differs in that its head 76 is hollow and contains means (not shown in FIG. 7) for producing a beam of sound waves which may be similar to emitter apparatus 15 of FIG. 1. The emitter transducer, in this case, may be mounted behind grille 77 set in the open face of club 75. Grille 77 may also be coupled to a pressure switch which performs, in the embodiment of FIG. 7, the function of trigger 13 of FIG. 1. A golf ball 78 is mounted near one end of a base plate 79, by means of a resilient support, such as spring 80. Spring 80 supports ball 78 in a simulated teed-up position. Near the other end of baseplate 79 is mounted means for indicating sound beam impingement, which may be similar to receiver apparatus 18 of FIG. 1.

In the arrangement of FIG. 7, the receiver transducer 18*a* is positioned to point toward golf ball 78, and is supported above baseplate 79 at the height which would be reached if a real golf ball placed like ball 78 were properly struck by a real club.

To play this game, club 75 is used to swing at ball 78. At contact, a sound beam is produced by the emitter apparatus inside the club. If, but only if the club is substantially correctly oriented, will that beam impinge on receiver transducer 18*a* and cause indicator 21 to respond.

By appropriate adjustment of the position of transducer 18*a*, various conditions of ball lie, distance and other game factors can be simulated.

It will be understood that still other modifications and applications will occur to those skilled in the art without departing from the inventive concept.

For example, the emitter of sound waves in accordance with my invention may be constructed so as to provide series of bursts of such sound waves directed toward a receiver. Interruption of the reception, as by the passage of an object through their path can then be signaled by the receiver. To this end, the emitter could be provided with multivibrator circuitry for alternately energizing and deenergizing the oscillator circuit and the receiver could be provided with conventional circuitry for sensing the non-reception of a predetermined plurality of such bursts and signaling that event.

What is claimed is:

1. A system of simulating the firing and trajectory of a projectile comprising:

a. a portable apparatus for simulating the launching of a single projectile at a time having means for visually aiming said apparatus and means for producing a narrowly dispersed aimable beam of sound waves in a predetermined frequency range, said beam simulating the substantially straight trajectory of said single projectile in response to the manual orientation and actuation of said launcher by an operator, and b. target means mounted separately from said launcher and being constructed to respond primarily to impingement thereupon of said aimed beam, said means being substantially non-responsive to sound waves outside said predetermined frequency range, said target means also including means for producing an indication when it responds.

2. The system according to claim 1 wherein said launcher emits said beam as a pulse having a predetermined duration only in response to a corresponding manual operation by said operator.

3. The system according to claim 2 wherein said indication has a duration longer than the duration of said emitted pulse.

4. The system according to claim 3 wherein said indication ceases at a predetermined time after the cessation of the detection of said emitted pulse.

5. The apparatus of claim 1 wherein said sound wave beam emitting means comprises a piezoelectric transducer, means for electronically exciting said transducer, and means for forming the sound waves from said transducer into said beam.

6. The apparatus of claim 5, wherein said target means comprises a second piezoelectric transducer adapted to be exposed to said sound waves, means for detecting the electrical signals produced by said second transducer in response to said sound waves, and means for indicating said detection.

7. The system according to claim 1 wherein said sound is ultrasonic.

8. The system according to claim 1 wherein said indication is a visible indication.

9. The system according to claim 1 wherein said indication is an audible indication.

10. The system according to claim 1 wherein said target means produces said indication only when said detected pulse has a predetermined duration.

11. The system according to claim 1 wherein said target means comprises directional means for limiting the response thereof to the impingement of said beam thereupon only at predetermined angles.

12. A system of simulating the firing and trajectory of a projectile comprising:

a. a portable apparatus for simulating the launching of a single projectile at a time in the form of a toy fire-arm having a barrel which emits an aimable beam of sound waves in a predetermined frequency range, said barrel having mounted therein a piezoelectric transducer, means for electronically exciting said transducer and means for forming the sound waves from said transducer into said beam, said launching apparatus being manually orientable and actuatable by an operator, and b. target means mounted separately from said launcher and being constructed to respond primarily to impingement thereupon of said aimed beam, said means being substantially non-responsive to sound waves outside said predetermined frequency range, said target means also including means for producing an indication when it responds.

13. A system for simulating the firing and trajectory of a projectile comprising:

a. a portable simulated projectile launcher which emits and aimable beam of sound waves in a predetermined frequency range in response to the manual orientation and actuation of said launcher by an operator, said launcher also including adjustable means for varying the dimensions of said beam, and b. target means mounted separately from said launcher and being constructed to respond primarily to impingement thereupon of said aimed beam, said means being substantially non-responsive to sound waves outside said predetermined frequency range, said target means also including means for producing an indication when it responds.

* * * * *